US006371871B1

(12) United States Patent
Rappaport et al.

(10) Patent No.: US 6,371,871 B1
(45) Date of Patent: Apr. 16, 2002

(54) MEMBER FOR PROVIDING A CONTROLLED PROPULSION OF ELEMENTS TOWARD THE MEMBER BY PROPULSION APPARATUS

(76) Inventors: Mark J. Rappaport, P.O. Box 112, Rancho Santa Fe, CA (US) 92067; Jose E. Leal, 5 Durant Ave., Maynard, MA (US) 01754

( * ) Notice: Subject to any disclaimer, the term of this patent is extended or adjusted under 35 U.S.C. 154(b) by 0 days.

(21) Appl. No.: 09/718,306

(22) Filed: Nov. 21, 2000

Related U.S. Application Data

(62) Division of application No. 09/231,195, filed on Jan. 14, 1979, now Pat. No. 6,190,271.

(51) Int. Cl.[7] ..... A63B 69/00

(52) U.S. Cl. ..... 473/457; 473/451; 473/422; 124/6; 124/34; 124/32

(58) Field of Search ..... 473/150–152, 473/222–234, 451–453, 461–464, 458, 459, 457, FOR 105, FOR 168, FOR 169; 73/492, 493, 584, 12.02, 12.01; 124/6, 7, 34, 32, 78

(56) References Cited

U.S. PATENT DOCUMENTS

| | | | | | |
|---|---|---|---|---|---|
| 3,561,272 | A | * | 2/1971 | Davis | 473/233 |
| 3,945,646 | A | * | 3/1976 | Hammond | 473/223 |
| 4,753,442 | A | * | 6/1988 | Bland | 473/424 |
| 4,759,219 | A | * | 7/1988 | Cobb et al. | 73/493 |
| 4,834,376 | A | * | 5/1989 | Steinberg | 473/457 |
| 5,056,783 | A | * | 10/1991 | Matcovich et al. | 473/453 |
| 5,066,010 | A | * | 11/1991 | Pingston | 473/451 |
| 5,071,122 | A | * | 12/1991 | Messina | 473/429 |
| 6,244,260 | B1 | * | 6/2001 | Ragoza et al. | 124/6 |

* cited by examiner

*Primary Examiner*—William M. Pierce
*Assistant Examiner*—Mitra Aryanpour
(74) *Attorney, Agent, or Firm*—Ellsworth R. Roston; Fulwider Patton, et al.

(57) ABSTRACT

A member (e.g. baseball bat) including a switch manually operable to obtain the transmission of signals by a transmitter in the member to an apparatus for propelling an element (e.g. ball) toward an individual holding the member. The element is propelled by a propulsion mechanism in the apparatus toward the individual holding the member so that the individual can practice receiving the element (e.g. hitting the ball). The apparatus propels the element upon the receipt of the transmitted signals and prepares for the next element in the apparatus to be propelled upon a receipt of subsequent signals from the transmitter.

20 Claims, 5 Drawing Sheets

MEMBER FOR PROVIDING A CONTROLLED PROPULSION OF ELEMENTS TOWARD THE MEMBER BY PROPULSION APPARATUS

This application is a division of application Ser. No. 09/231,195 (now U.S. Pat. No. 6,190,271 B1) filed in the U.S. Patent Office on Jan. 14, 1979.

This invention relates to apparatus for providing an individual with an opportunity to practice receiving an element. For example, the invention relates to apparatus which propels balls toward a batter so that the batter can practice hitting the propelled balls. The invention is particularly advantageous because the batter can control when the ball is propelled toward the hitter.

BACKGROUND OF THE INVENTION

Many youngsters are interested in improving their skills in hitting a baseball. Because of this, machines have been provided on a commercial basis for pitching balls to a batter. The batter positions himself or herself in a batting cage and the machine then transmits a plurality of balls in sequence to the batter. The batter pays for this by inserting coins into a coin box or by paying a cashier.

There are at least three (3) problems with the arrangement described in the previous paragraph. One problem is that the batter cannot control when successive balls are propelled to the batter by the pitching machine. Another problem is that the batter has to travel to the site of the pitching machine, this being an inconvenience to the batter. A third disadvantage is that the pitching machines propel the balls at a high velocity toward the batter. This may be advantageous to teenagers and adults but it is not advantageous to pre-teenagers.

BRIEF DESCRIPTION OF THE INVENTION

This invention provides an apparatus for overcoming the disadvantages discussed in the previous paragraph. The apparatus of this invention provides for control by an individual (e.g. a batter) at times when a machine propels an element (e.g. a ball) for operation of a member (e.g. a bat) by the individual (e.g. batter). The apparatus of this invention is portable even by pre-teenagers so that the individual operating the member (e.g. the bat) can practice anywhere including the individual's backyard or a friend's backyard. The apparatus of this invention is especially designed to be used by pre-teenagers.

Although a pitching machine is shown in the drawings to be a preferred embodiment of the invention, it will be appreciated by persons of ordinary skill in the art that other embodiments are within the scope of the invention. For example, the apparatus of this invention can be adapted to propel hockey pucks to a player holding a hockey stick or to propel lacrosse balls to a player holding a lacrosse stick.

In one embodiment of the invention, a member (e.g. baseball bat) includes a switch manually operable to obtain the transmission of signals by a transmitter in the member to an apparatus for propelling an element (e.g. ball) toward an individual holding the member. The apparatus propels the element upon the receipt of the transmitted signals and prepares for a next ball in the apparatus to be propelled upon a receipt of a subsequent signal from the transmitter.

The element is propelled by the propulsion mechanism in the apparatus toward the individual holding the member so that the individual can practice receiving the element (e.g. hitting the ball).

DETAILED DESCRIPTION OF THE INVENTION

Figure 1:
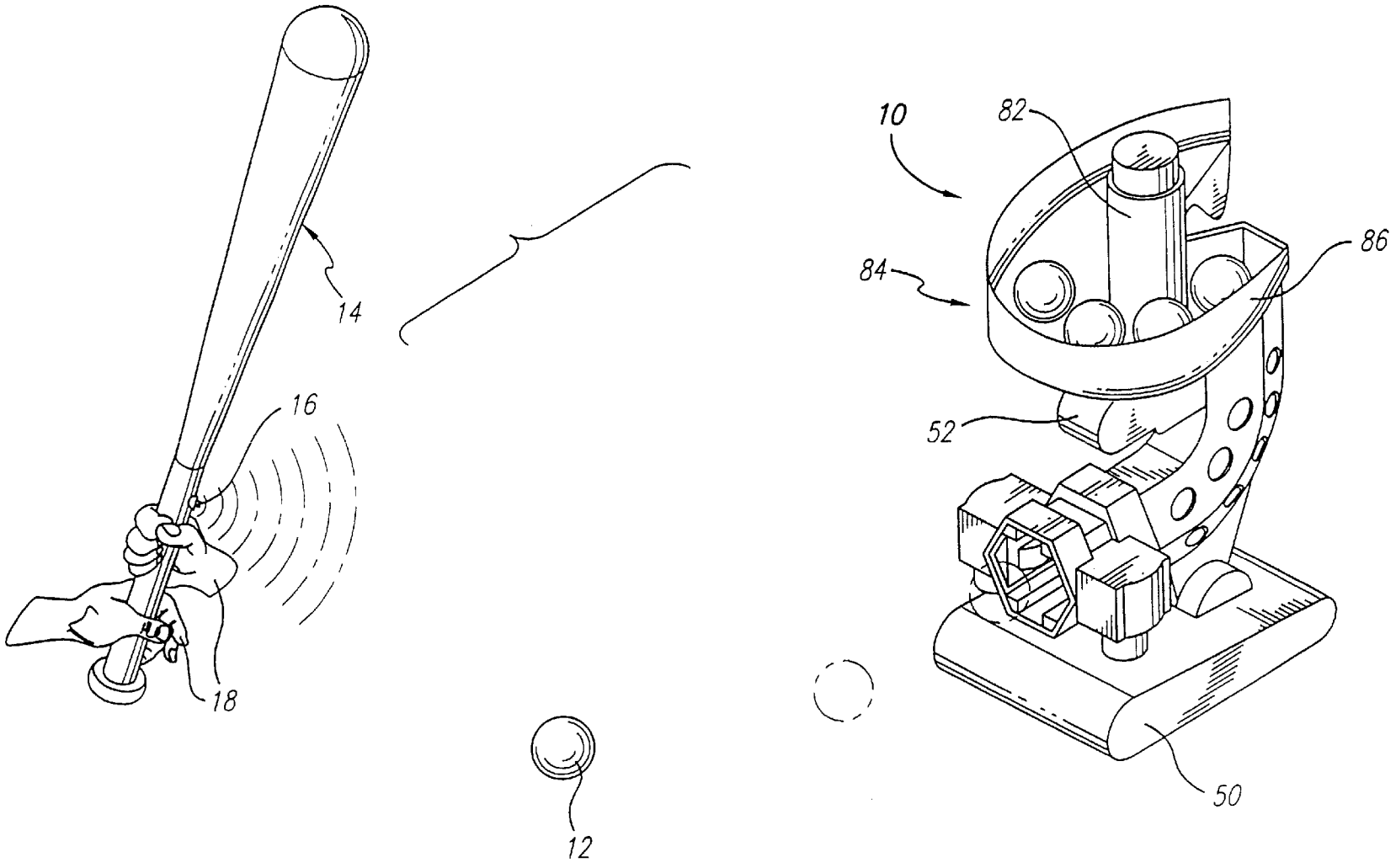
FIG. 1 is a perspective view of (1) a baseball bat and the hands of an individual swinging the bat to hit a ball propelled toward the bat, (2) pitching apparatus for propelling the ball toward the bat and (3) the movement of the ball from the pitching apparatus toward the bat.

In one embodiment of the invention, apparatus generally indicated at 10 (FIG. 1) is provided for propelling an element (e.g. a ball) 12 toward a member (e.g. a ball) generally indicated at 14., the force-imposing member (e.g. a bat) 14 having a first portion for manual grasping and movement by a player and a second portion for imposing a force on an element (e.g. a ball) 12 moving toward the member, wherein the first and second portions of the member are positioned in the direction of the elongation of the member, and the second portion of the member is wider than the first portion of the member. The ball 12 maybe a hard or a soft ball generally provided for baseball games. Preferably the ball is a hollow plastic ball having a light weight and constructed to limit the speed of the ball and the distance of travel of the ball. This ball is advantageous when the hitter is a child generally less than ten (10) years old.

A switch 16 (FIG. 4) is provided on the bat 14, preferably at a position above the positions on the handle portion where the batter's hands 18 grip the bat when the batter is swinging at the ball 12. The switch 16 is pressed by the batter when the batter desires to have the apparatus 10 propel the ball 12 toward the batter. The switch 16 is located between the first and second portions of the member in the direction of the elongation of the member.

Figure 5:
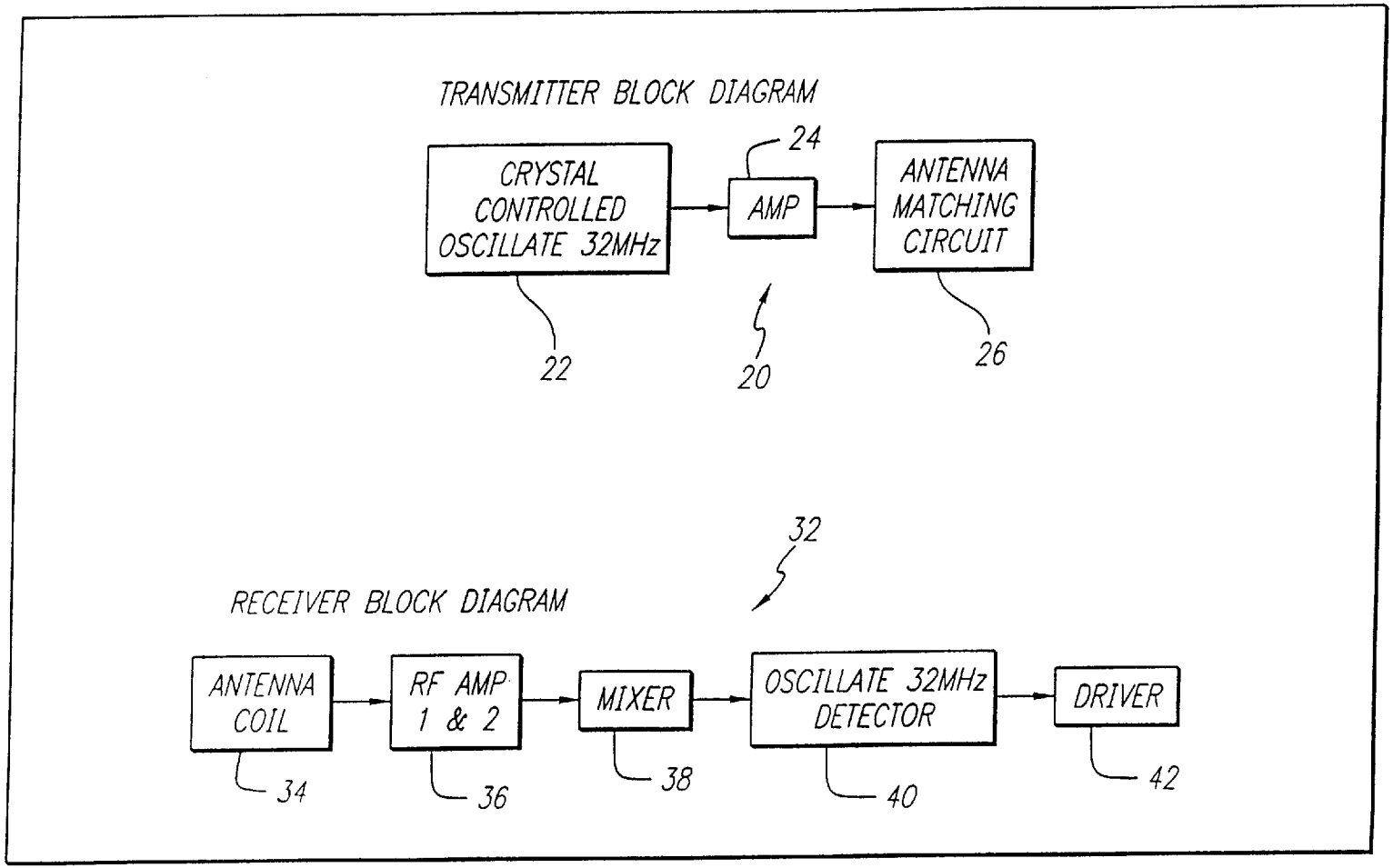
FIG. 5 shows a block diagram of a transmitter in the bat for transmitting signals to the pitching apparatus and a block upon the closure of the switch in FIG. 4 and a block diagram of a receiver in the pitching apparatus for receiving the signals transmitted from the bat and for activating the pitching machine to propel a ball toward the bat.

A transmitter generally indicated at 20 in FIG. 5 is disposed in the bat 14 to transmit signals to the pitching apparatus 10 for obtaining the propulsion of the ball 12 by the pitching apparatus toward the bat 14. In one embodiment, the transmitter 20 may include an oscillator 22 for producing signals at a particular frequency such as approximately thirty-two megahertz (32 MHz). The oscillator 22 may be crystal controlled.

The signals from the oscillator 22 may be amplified at 24 and the amplified signals may be introduced to an antenna 26 which may be provided with an impedance preferably matching the impedance of the amplifier 24. An energy source such as a battery 28 (FIG. 4) may be removably disposed in the bottom 30 of the bat to energize the transmitter 20.

A receiver generally indicated at 32 in FIG. 5 may be disposed in the pitching apparatus 10 to receive the signals transmitted from the bat 14. The receiver 32 may include an antenna 34 which may be in the form of a coil. Amplifiers 36 may be provided to amplify the received signals. The amplified signals may then be mixed at 38 and the mixed signals may then be detected as at 40 to recover the signals at thirty-two megahertz (32 MHz). The detected signals may then be introduced to a driver 42.

Figure 2:
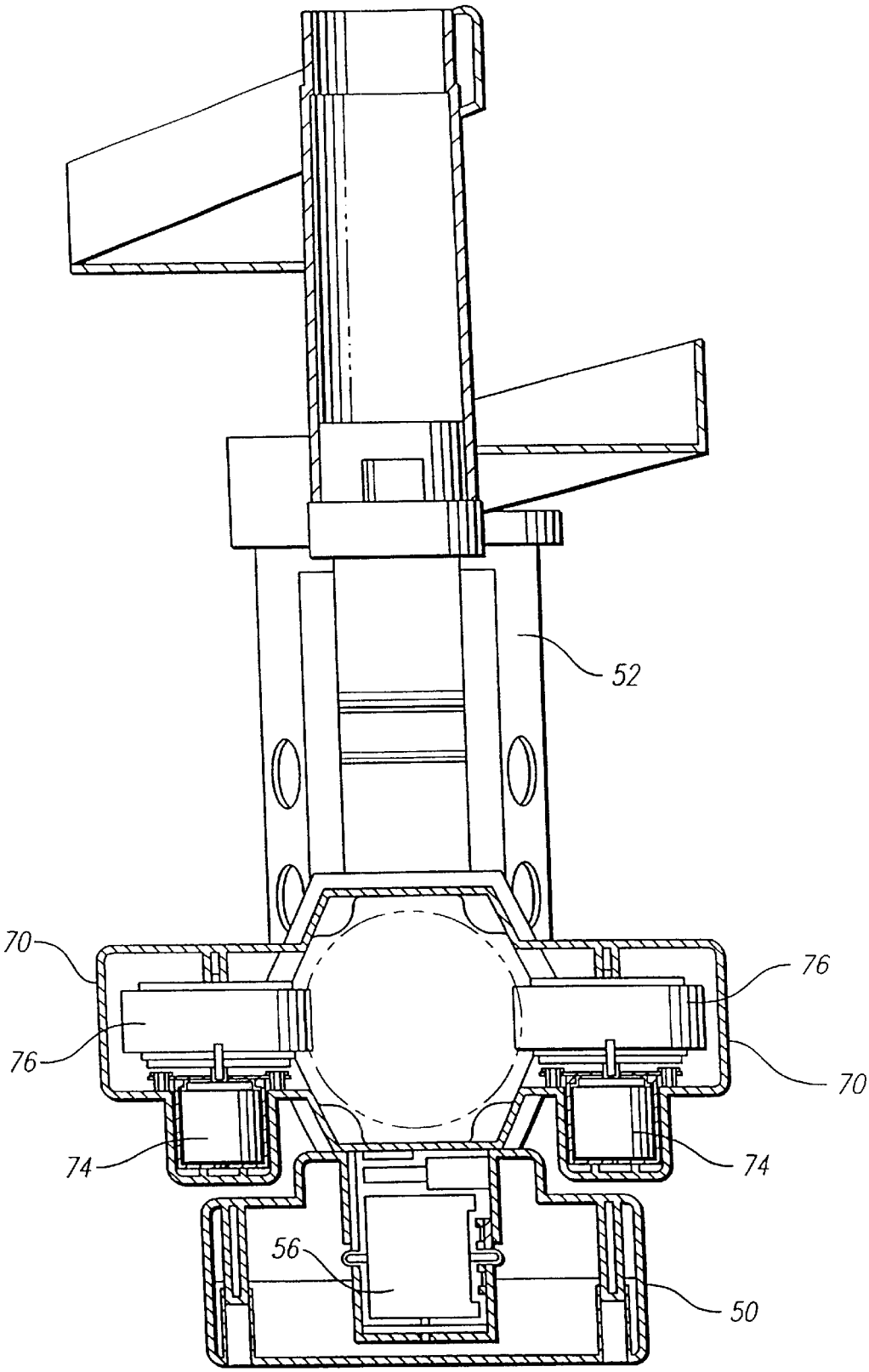
FIG. 2 is a sectional view in elevation of the pitching apparatus shown in FIG. 1 as seen from a position in front of the apparatus.
Figure 3:
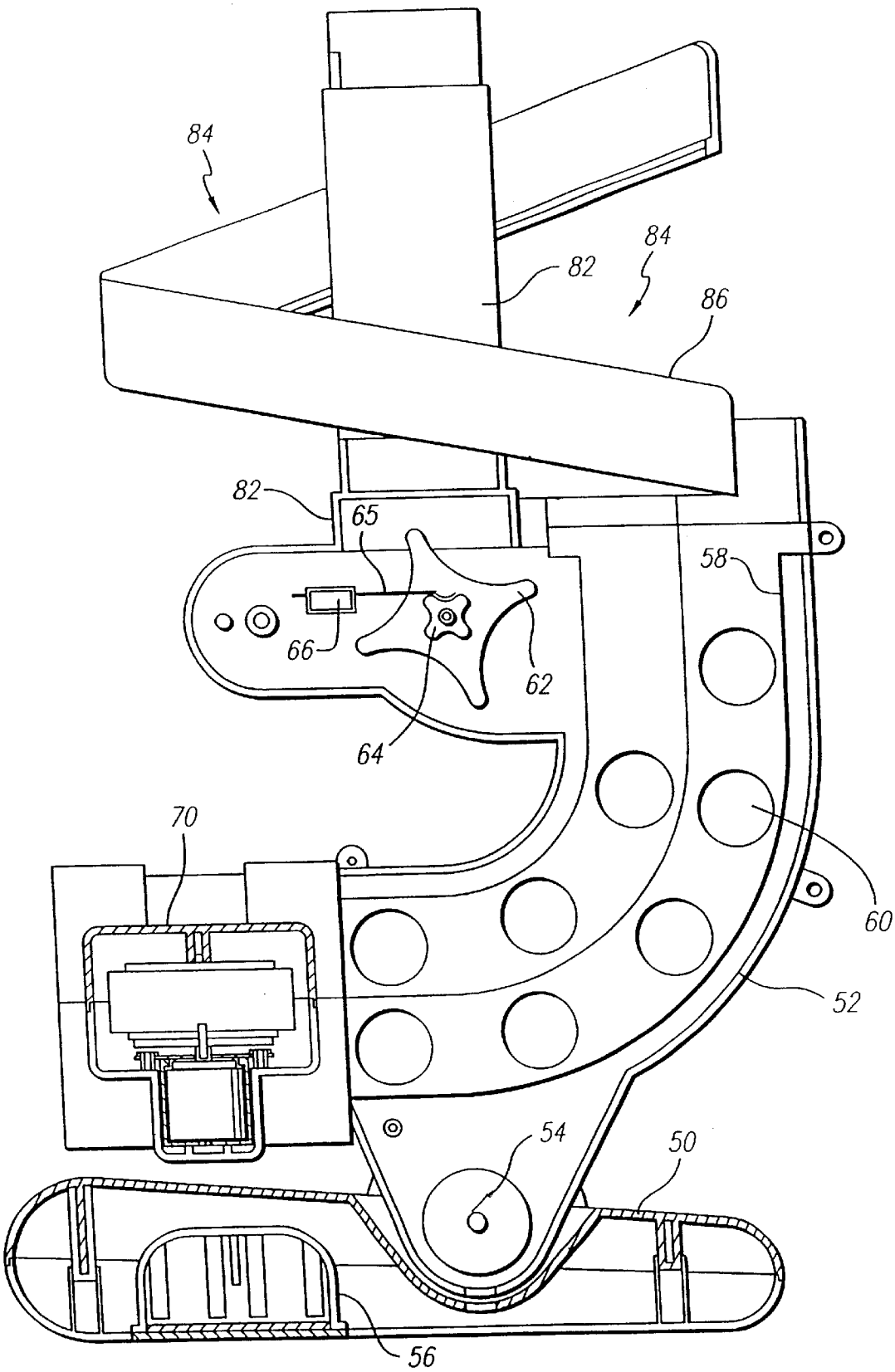
FIG. 3 is an elevational view, partially in section, of the pitching apparatus as seen from a position to one side of the apparatus.

The apparatus 10 includes a base member 50 (FIGS. 1–3) and a housing 52 pivotably attached to the base member as at 54. The base member is adapted to be supported on a support surface such as the ground. The base member 50 is adapted to hold a transportable energy source such as a battery 56.

The housing 52 is provided with a hollow passage 58. Holes 60 may be provided in the housing 52 at progressive positions along the passage 58, primarily for aesthetic purposes. The ball 12 is adapted to be disposed in the hollow passage 58 against a plurality of annularly spaced fingers 62 in a rotatable detainer 64 having a shape such as a star wheel. The detainer 64 is normally engaged by a release mechanism 65 which is actuated to be withdrawn from engagement with the detainer when a solenoid 66 is energized.

The hollow passage 58 is initially disposed vertically and is progressively curved at progressive downward positions to have a horizontal disposition. A pair of pockets 70 are disposed in the housing 52 at the opposite sides of the housing at positions where the hollow passage 58 is substantially horizontal. Two (2) motors 74 are provided, one disposed in one of the pockets 70 and the other disposed in the other one of the pockets 70. Two (2) actuators are provided, one disposed in one of the pockets 70 and the other disposed in the other one of the pockets 70.

The motor 74 and the roller 76 in each pocket 72 are operatively coupled to each other to provide a rotation of the roller in accordance with the energizing of the motor. The rollers 76 are preferably made from a resilient material and are preferably extended into the hollow passage 58 to grip the opposite ends of the ball 12 in the passage and to propel the ball from the passage in accordance with the rotation of the rollers. The motors 74 and the rollers 76 may be considered as a propulsion mechanism.

Figure 6:
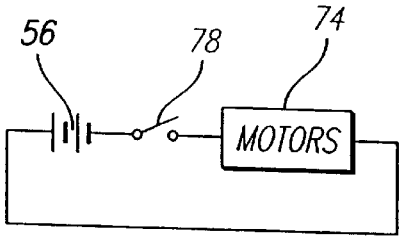
FIG. 6 is a schematic diagram of an electrical circuit for energizing motors in the pitching apparatus when a ball is disposed in the pitching apparatus, thereby providing for the propulsion of the ball from the pitching apparatus when the receiver receives signals from the transmitter.

The battery 56 and the motors 74 are disposed in a series circuit (FIG. 6) with a normally open switch 78. The switch 78 becomes closed when the ball 12 is disposed on the finger 62 of the detainer 64. The closure of the switch 78 at such time results from the fact that each finger 62 has some play in its positioning. This causes each finger 62 to be disposed upwardly, with no ball on the finger, from the position which it occupies when the ball 12 is disposed on the finger. In the upward position of the finger 62, the switch 78 is open.

In this way, the motors 74 are energized only when the ball 12 is in the hollow passage 58 in a position to be propelled from the hollow passage when a signal from the transmitter 20 is received by the receiver 32. Furthermore, energy is conserved in the battery 56 to prolong the life of the battery since the battery provides energy to the motors 74 only when the ball 12 is disposed in the hollow passage 58.

The housing 52 is provided at its top end with a stanchion. A tube 82 forming a part of ramp generally indicated at 84 fits snugly on the stanchion in a removable relationship to the stanchion. The ramp 84 defines an inclined track 86 extending in a spiral path to a position at its bottom end above the hollow passage 58. A plurality of the balls 12 are disposed on the track 86 for a movement of each ball in sequence into the hollow passage 58 when the ball previously in the hollow passage is propelled by the rollers 76 from the passage toward the batter holding the bat 14.

Assume that the ramp 84 is disposed on the stanchion at the top of the housing 52 and that one of the balls 12 on the track 86 has dropped into the hollow passage 58 for disposition on the finger 62 extending into the hollow passage. This causes the finger 62 on the detainer 64 to be positioned to close the switch 78 in FIG. 6 and the motors 74 to be energized. The resultant rotation of the rollers 76 provides for the propulsion of the ball from the hollow passage 58 when the ball is released by the detainer 64.

Figure 4:
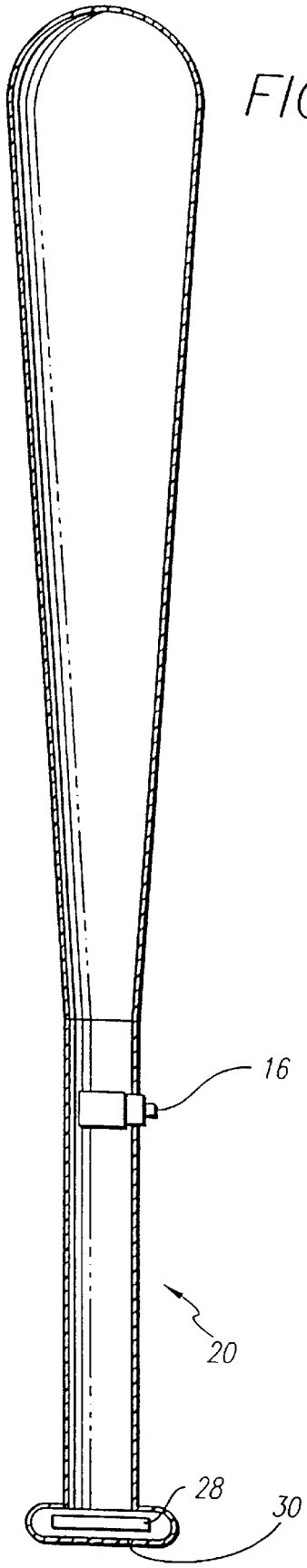
FIG. 4 is an enlarged sectional view in elevation of the bat and includes a switch manually operable to provide for a transmission of signals from the bat to the pitching apparatus.

When the batter manually closes the switch 16 in FIG. 4, signals are transmitted by the transmitter 20 in FIG. 5 to the receiver 32 in FIG. 5. This causes the solenoid 66 (FIG. 3) to be energized and the release mechanism 65 to be retracted from the detainer 64. The detainer 64 is now free to be rotated in a counterclockwise direction by the ball 12 on the finger 62. This rotation frees the ball 12 to move downwardly in the hollow passage 58 to a position between the rollers 76. Since the rollers 76 are already being rotated by the motors 74, the rollers propel the ball 12 from the hollow passage toward the batter when the ball reaches the rollers. When the ball 12 is dropping through the hollow passage 58, the next ball on the track 86 drops into the hollow passage for disposition against one of the fingers 62.

The apparatus described above has been disclosed with reference to a pitching machine for baseball. It is believed that a person of ordinary skill in the art will be able with little or no experimentation to adapt the apparatus for other uses. For example, it is believed that a person of ordinary skill in the art will be able to adapt the invention for use by a hockey player or for use by a lacrosse player.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the claims.

What is claimed is:

1. In combination, a member manually operable by a player holding the member for propelling an element, a first portion of the member being shaped to be grasped by the player's hands and another portion of the member being shaped to impose a force on an element, a switch located on the member for manual pressure by the player, and a transmitter disposed in the member for sending signals to a propulsion apparatus, when the switch is manually pressed by the player, to obtain a propulsion of an element by a propulsion apparatus toward the member for the imposition of a force by the member on an element.

2. In a combination as set forth in claim 1, the switch being disposed at a position on the member above the position at which the player's hands grasp the member.

3. In a combination as set forth in claim 1, battery removably disposed in the member to energize the transmitter in the member when the switch is pressed.

4. In a combination as set forth in claim 2, the member being hollow, and a battery removably disposed in the hollow member at a position at the bottom of the member to energize the transmitter in the member when the switch is pressed.

5. In a combination as set forth in claim 4, the member being in the shape of a bat for receiving elements propelled from a propulsion apparatus.

6. In combination, a force-imposing member having a first portion for manual grasping and movement by a player and having a second portion for imposing a force on an element moving toward the member, a switch located on the member, the switch having first and second states of operation and being manually actuatable between the first and second states, and a transmitter disposed in the member and operatively coupled to the switch for transmitting signals upon a manual actuation of the switch between the first and second states.

7. In a combination as set forth in claim 6 wherein the member is elongated and wherein the first and second portions of the elongated member are displaced from each other in the direction of the elongation of the member and wherein the switch is disposed between the first and second portions of the member in the direction of the elongation of the member.

8. In a combination as set forth in claim 6 wherein the first and second portions of the member are not in the same position and wherein the switch is disposed between the first and second portions of the member in the direction of the elongation of the member.

9. In a combination as set forth in claim 6 wherein an energy source is disposed in the member for energizing the transmitter to transmit signals when the switch is actuated between the first and second states of operation.

10. In a combination as set forth in claim 8 wherein an energy source is removably disposed in the member at the bottom of the member to provide energy to the transmitter for transmission of the signals by the transmitter when the switch is manually actuated between the first and second states of operation.

11. In a combination as set forth in claim 9 wherein the transmitter includes an oscillator for producing signals at a particular frequency for transmission by the transmitter when the switch is actuated between the first and second states of operation.

12. In a combination as set forth in claim 6 wherein the transmitter transmits the signals on a wireless basis.

13. In a combination as set forth in claim 8 wherein the transmitter includes an oscillator for producing signals at a particular frequency for transmission by the transmitter and wherein the transmitter transmits the signals on a wireless basis and wherein the second portion of the member is wider than the first portion of the member.

14. In a combination as set forth in claim 9 wherein the member is elongated and wherein the first and second portions of the elongated member are in the direction of the elongation of the member and wherein the switch is between the first and second portions of the member in the direction of the elongation of the member.

15. In a combination as set forth in claim 13 wherein the member is a baseball bat.

16. In a combination as set forth in claim 1, the transmitter being constructed to send the signals on a wireless basis to the propulsion apparatus.

17. In combination, a member manually operable by a player holding the element, a first portion of the member being shaped to be grasped by the player's hands and another portion of the member being shaped to impose a force on an element propelled toward the member, a switch located on the member for manual pressure by the player, and a transmitter disposed in the member for sending signals to a propulsion apparatus, to obtain a propulsion of an element by a propulsion apparatus toward the member when the switch is manually pressed by the player;

the member being in the shape of a bat for receiving elements propelled from a propulsion apparatus and for propelling elements, the transmitter being constructed to send the signals on a wireless basis to a propulsion apparatus.

18. In a combination as set forth in claim 6, the transmitter being constructed to transmit the signals on a wireless basis upon the manual pressure of the switch.

19. In a combination as set forth in claim 18, wherein the member is elongated and wherein the first and second portions of the elongated member are in the direction of the elongation of the member and wherein the switch is between the first and second portions of the member in the direction of the elongation of the member and wherein an energy source is removably disposed in the member at the bottom of the member to transmit signals when the switch is manually pressed.

20. In a combination as set forth in claim 19 wherein the member is a baseball bat.

* * * * *

UNITED STATES PATENT AND TRADEMARK OFFICE

CERTIFICATE OF CORRECTION

PATENT NO. : 6,371,871 B1
DATED : April 16, 2002
INVENTOR(S) : Mark J. Rappaport et al.

It is certified that error appears in the above-identified patent and that said Letters Patent is hereby corrected as shown below:

Title page,
Item [62], Related U.S. Application Data, change “1979”, to read -- 1999 --.

Column 1,
Line 8, change “1979”, to read -- 1999 --.

Column 2,
Line 35, change “ball”, to read -- bat --.

Column 5,
Line 46, claim 10, delete “the”, first occurrence.

Signed and Sealed this

Fifth Day of November, 2002

*Attest:*

*Attesting Officer*

JAMES E. ROGAN
*Director of the United States Patent and Trademark Office*